US006752064B2

(12) United States Patent
Wheeler

(10) Patent No.: US 6,752,064 B2
(45) Date of Patent: Jun. 22, 2004

(54) FLUID PRESSURE POWERED MOTOR

(76) Inventor: Roland T. Wheeler, 744 Empire Ave., Modesto, CA (US) 95354

( * ) Notice: Subject to any disclaimer, the term of this patent is extended or adjusted under 35 U.S.C. 154(b) by 0 days.

(21) Appl. No.: 10/191,200

(22) Filed: Jul. 10, 2002

(65) Prior Publication Data

US 2004/0009082 A1 Jan. 15, 2004

(51) Int. Cl.[7] ..... F01B 1/06; F04B 7/00

(52) U.S. Cl. ..... 91/493; 91/481; 417/515

(58) Field of Search ..... 91/493, 481; 417/510, 417/515, 516, 517, 518, 519

(56) References Cited

U.S. PATENT DOCUMENTS

| | | | | | |
|---|---|---|---|---|---|
| 2,088,582 | A | * | 8/1937 | Bishop | 91/161 |
| 4,106,391 | A | * | 8/1978 | Wheeler | 91/481 |
| 4,598,628 | A | * | 7/1986 | Courtright | 91/481 |
| 5,163,822 | A | * | 11/1992 | Koelln | 417/515 |
| 6,030,185 | A | * | 2/2000 | Feigel et al. | 417/273 |

* cited by examiner

*Primary Examiner*—Justine R. Yu
*Assistant Examiner*—Michael K. Gray
(74) *Attorney, Agent, or Firm*—Alfred F. Hoyte, Jr.

(57) ABSTRACT

A radial, fluid pressure actuated motor having sets of opposed axially aligned cylinders arranged in a spaced relation about a crankshaft, each set of cylinders having a common push rod extending between them. Each push rod has a central Scotch yoke with an elongated slot, the yokes being arranged in overlying spaced relation, the slots being arranged in right angular intersecting relation. A primary or main crankpin extending from the crankshaft extends in journaled but slidable relation through the slots of the Scotch yokes. Fluid pressure is fed into, and exhausted from, each of the cylinders in a predetermined cyclic order, the fluid pressure operating to power, in both directions of travel, axial movement of the push rods thereby imparting continuous rotating motion to the crankshaft via the main crankpin. Each set of opposed cylinders has a corresponding set of opposed spool valves for controlling application of fluid pressure to the cylinders, and each spool valve contains an axially reciprocal spool having a common connecting rod extending between them. Each connecting rod has a centrally disposed Scotch yoke formed therein, and each Scotch yoke associated with the connecting rods has an elongated slot formed therein, so that the elongated slots are in spaced, overlying, right angular relation. A timing disc driven by the crankshaft via the main crankpin, has a plurality of apertures formed therein, the apertures circumferentially spaced at regular intervals. The main crankpin is removably insertable into a selected one of the apertures, and an upper portion of the crankshaft extends from the timing disc, and terminates at a spool drive crankpin which extends through spool valve Scotch yokes, the spool drive crankpin thereby effecting reciprocal action of the spools. Timing of the valve operation is adjusted by adjusting the aperture of the timing disc through which the main crankpin is inserted, allowing the operator to adjust the valving in accordance with the intended operation.

3 Claims, 5 Drawing Sheets

Figure 4a
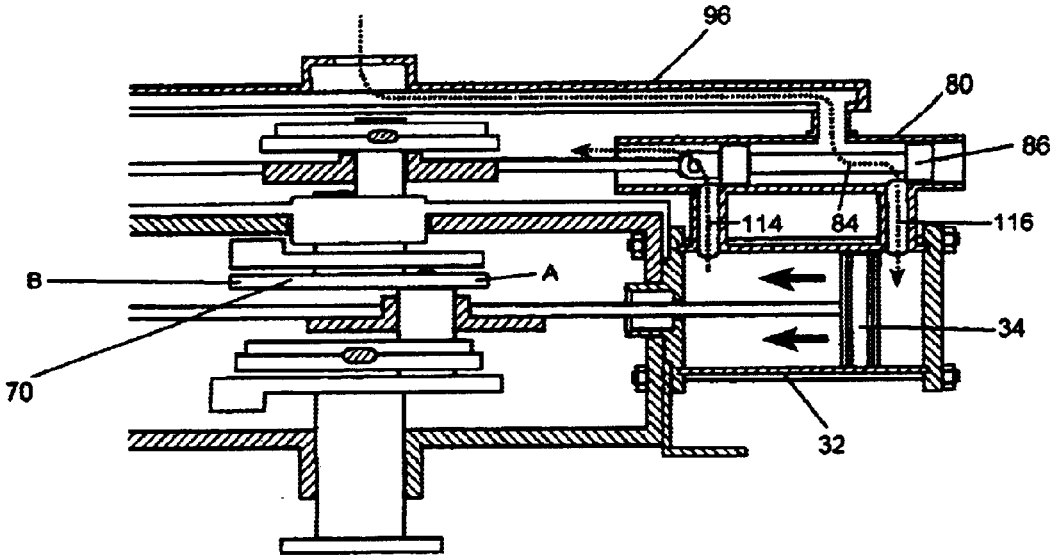
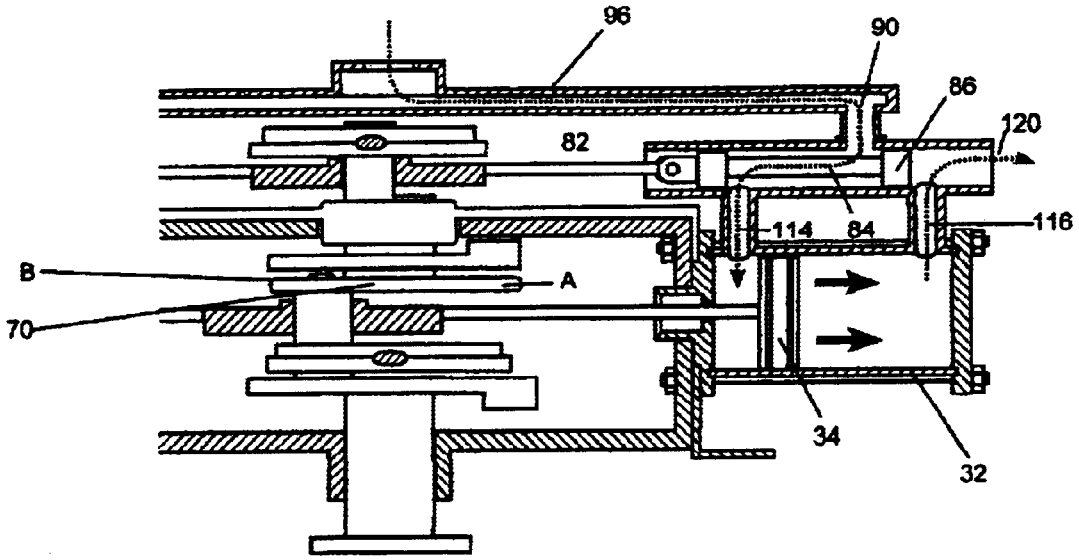
Figure 4b

FLUID PRESSURE POWERED MOTOR

BACKGROUND OF THE INVENTION

1. Field of the Invention

The present invention concerns a motor apparatus. More particularly, the invention is directed to a fluid pressure driven motor, which may be powered by pressurized fluid or steam.

2. Description of the Prior Art

With the current ecological and environmental problems plaguing the world, numerous approaches to reducing the amounts of pollutants introduced into the environment have been undertaken. One approach is the use of alternative power sources, especially for electrical power generation systems and the like. Most of the alternative approaches being pursued relate to new technology such as fuel cells and solar cells, or highly experimental refinements of known technology such as windmills, which have only a very limited application.

Fluid pressure motors, such as steam engines and the like have not received much attention in the burgeoning search for more eco-friendly power generation technology. Accordingly, relatively few fluid pressure motor concepts have been introduced recently, none of which provide any real advantage over known systems.

U.S. Pat. No. 4,106,391 issued to and owned by the applicant, discloses a fluid pressure driven motor concept which offers several advantages over conventional fluid pressure motors. The motor is pollution free, quiet running, and operates at relatively high torque with rapid acceleration. The horsepower to weight ratio is relatively high for a fluid pressure apparatus, and, as the motor is not an internal combustion motor, avoids the necessity of inclusion of conventional instrumentalities such as a carburetor, spark plugs, distributor, cam shaft, sprockets, and lifters. Finally, the motor is compact in size and can be oriented in any direction during operation.

The present invention represents an overall improvement over the '391 patent. First, the present invention allows for variable valve timing. Second, the inventive motor eliminates the link rods and other components disclosed in the '391 patent, allowing for quieter, more reliable operation. These and other improvements are disclosed in the following specification and drawings.

SUMMARY OF THE INVENTION

Briefly, the invention comprises a radial, fluid pressure actuated motor having sets of opposed axially aligned cylinders arranged in a spaced relation about a crankshaft, each set of cylinders having a common push rod extending between them. Each push rod has a central Scotch yoke with an elongated slot, the yokes being arranged in overlying spaced relation, the slots being arranged in right angular intersecting relation. A primary or main crankpin extending from the crankshaft extends in journaled but slidable relation through the slots of the Scotch yokes. Fluid pressure is fed into, and exhausted from, each of the cylinders in a predetermined cyclic order, the fluid pressure operating to power, in both directions of travel, axial movement of the push rods thereby imparting continuous rotating motion to the crankshaft via the main crankpin. Each set of opposed cylinders has a corresponding set of opposed spool valves for controlling application of fluid pressure to the cylinders, and each spool valve contains an axially reciprocal spool having a common connecting rod extending between them. Each connecting rod has a centrally disposed Scotch yoke formed therein, and each Scotch yoke associated with the connecting rods has an elongated slot formed therein, so that the elongated slots are in spaced, overlying, right angular relation. A timing disc driven by the crankshaft via the main crankpin, has a plurality of apertures formed therein, the apertures circumferentially spaced at regular intervals. The main crankpin is removably insertable into a selected one of the apertures, and an upper portion of the crankshaft extends from the timing disc, and terminates at a spool drive crankpin which extends through spool valve Scotch yokes, the spool drive crankpin thereby effecting reciprocal action of the spools. Timing of the valve operation is adjusted by adjusting the aperture of the timing disc through which the main crankpin is inserted, allowing the operator to adjust the valving in accordance with the intended operation.

It is a major object of this invention to provide a fluid pressure operated motor.

It is another object to provide a fluid pressure operated motor having adjustable valving means.

Finally, it is a general goal of the invention to provide improved elements and arrangements thereof in an apparatus for the purposes described which is dependable and fully effective in accomplishing its intended purposes.

These and other objects of the present invention will become readily apparent upon further review of the following specification and drawings.

The present invention meets or exceeds all the above objects and goals. Upon further study of the specification and appended claims, further objects and advantages of this invention will become apparent to those skilled in the art.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein:

FIG. 4(*a*) illustrates fluid flow through the motor of the present invention during a first half-cycle of operation.

FIG. 4(*b*) illustrates fluid flow through the motor of the present invention during a second half-cycle of operation.

DETAILED DESCRIPTION OF THE PREFERRED EMBODIMENTS

Figure 1:
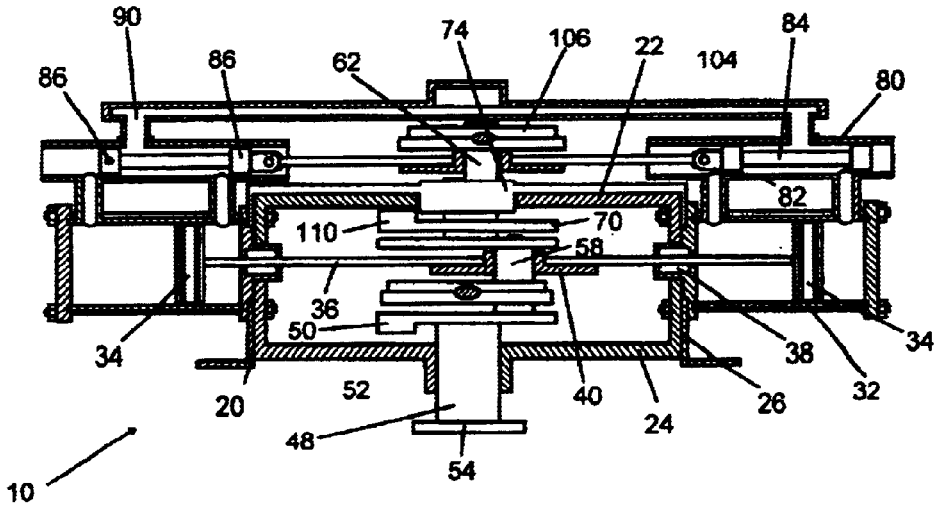
FIG. 1 is a side sectional view of the motor of the present invention.
Figure 2:
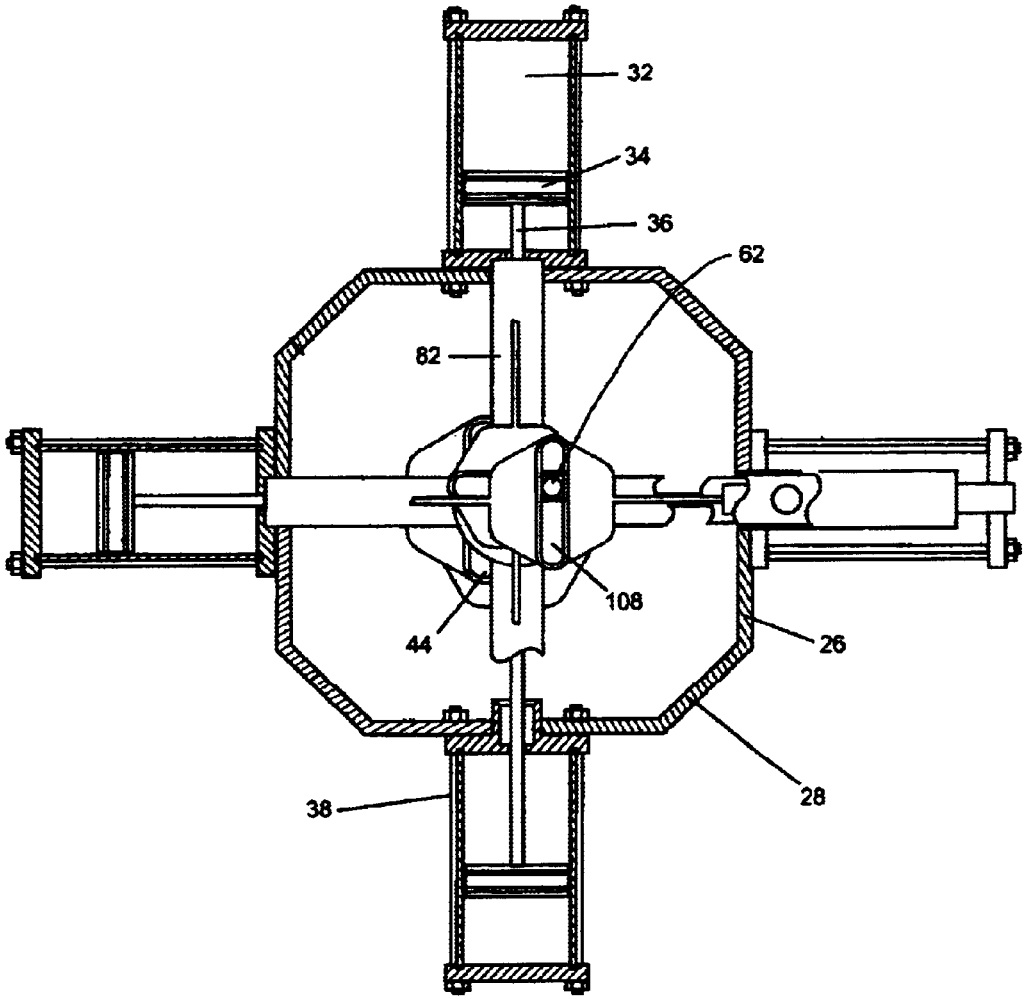
FIG. 2 is a sectional plan view of the motor of the present invention.

Referring now to FIGS. 1–5 the motor assembly of the present invention, generally indicated by the numeral 10, is shown. The motor 10 is preferably deck mounted and disposed in an axially horizontal position. The motor housing or crankcase 20 is substantially rectangular, such crankcase 20, which is axially relatively narrow, includes a front plate 22, a back plate 24, sides 26, and squared corners 28.

A cylinder 32 is mounted on, and radiates outwardly from, each side 26 of the crankcase 20; each set of opposed cylinders 32 being axially aligned, and the sets are slightly offset relative to each other, axially of the motor, to facilitate axial reciprocation.

The cylinders 32 each include a double-acting piston 34 reciprocably disposed therein, and the pistons 34 of each set of opposed cylinders 32 are coupled together by a common connecting rod 36 which runs from said cylinders 32 through packings 38 and into the crankcase 20.

Each connecting rod 36 includes a centrally disposed primary or main Scotch yoke 40, each main Scotch yoke 40 having a transverse, elongated slot 44; each slot extending at a right angle to the axis of the corresponding connecting rod 36, and the slots of the two rods 36 intersecting in right-angular relation.

As has been previously mentioned, the sets of opposed cylinders 32 are axially offset, relative to each other, and there is therefor no interaction between connecting rods 36 or main Scotch yokes 40. An axial crankshaft 48 is radially centered between said sets of opposed cylinders 32. The crankshaft 48, is counter balanced by counterweight 50, and terminates exteriorly of the crankcase in power output shaft 52, which is journaled through the back plate 24. The power output shaft 52 terminates in a radial flange 54 which allows for connection to an apparatus to be rotatably driven such as an electrical generator. A crankpin 58 is fixedly attached to and extends from counterbalance 50 into and through—in journaled but shiftable relation—the slots 44 of the right-angularly intersecting main Scotch yokes 40. Reciprocal motion of double action pistons 34 effects rotation of crankshaft 48 under throttle control, with lubrication and valving as is described in U.S. Pat. No. 4,106,391 issued to the present inventor R. T. Wheeler, which is hereby incorporated by reference. The present invention allows for improved control over the cyclic relation of piston 34 actuation by means of a Scotch yoke and slide valve timing assembly, which is adjustably driven by an eccentric portion 62 of the upper segment 64 of crankshaft 48 as will be explained in more detail below.

Figure 3:
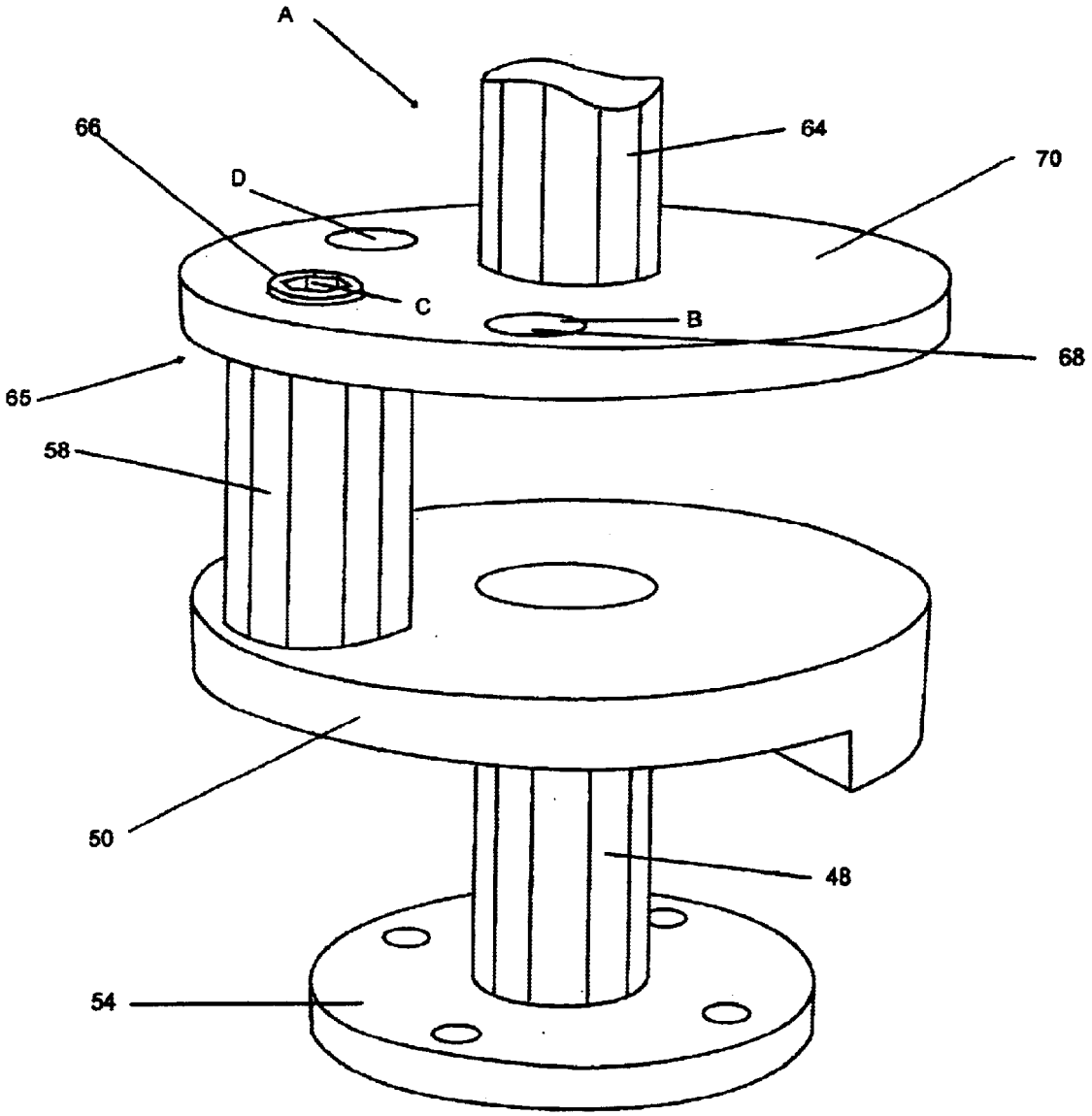
FIG. 3 is a perspective view of a counterbalance and timing disk assembly used in the motor of the present invention.
Figure 5:
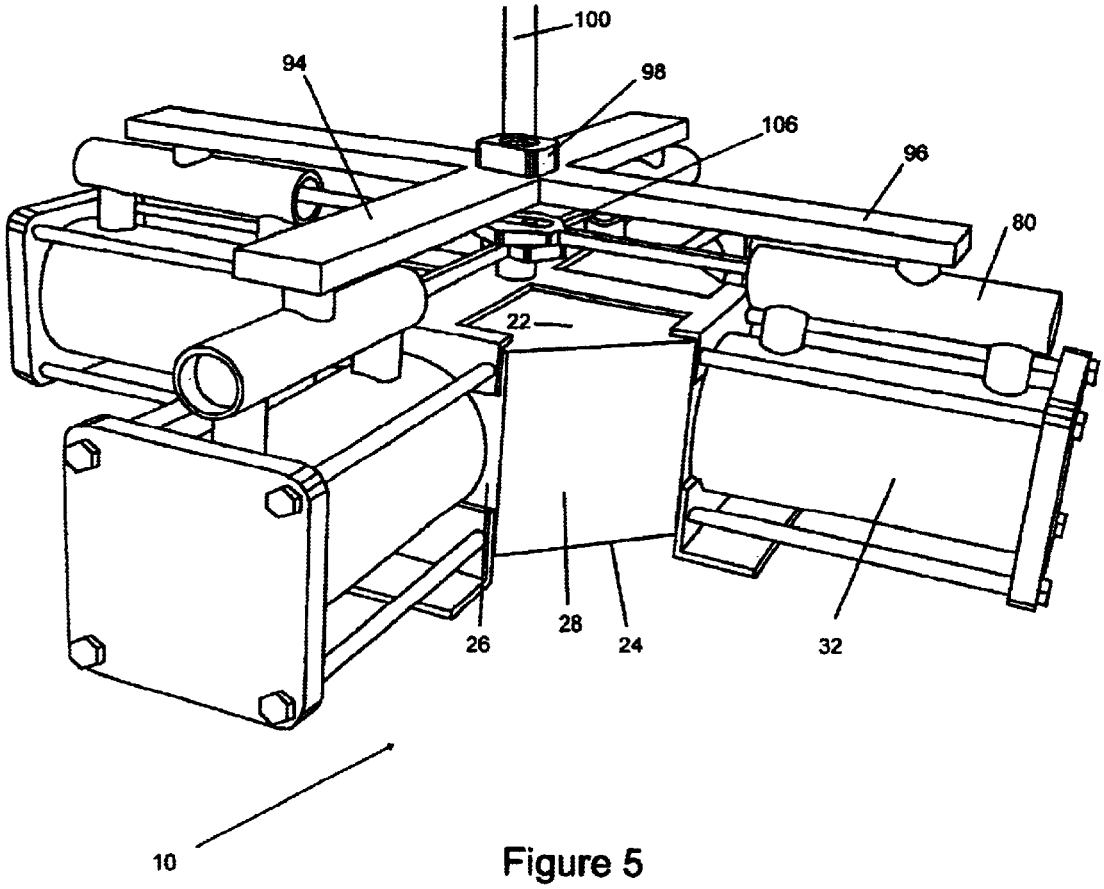
FIG. 5 is a perspective view of the motor of the present invention.

With specific reference to FIG. 3, it can be seen that crankpin 58 extends upwardly from counterbalance 50 and has formed at its upper end a central threaded bore 65, into which timing lug 66 may be threadably engaged. The timing lug can be inserted into and through any of several timing apertures 68 formed in timing disk 70, thereby allowing co-rotation of timing disk 70 and crankpin 58. The upper segment 64 of crankshaft 48 is fixedly attached centrally of timing disk 70, extending upwardly therefrom substantially perpendicularly to the plane of the disk 70, into and through a bearing housing 74.

Each cylinder 32 has a corresponding elongated spool-type, slide valve 80, fixedly mounted in adjacent parallel relation thereto. Each slide valve 80 includes a tubular sleeve 82 which houses an axially slidable or reciprocable spool 84 having axially spaced heads 86, with the spool of reduced diameter between such heads. The tubular sleeve 82 of each slide valve 80 is open at both its inner and outer ends, said ends alternately functioning as exhaust ports. Each slide valve 80 includes, in the sleeve 82, a fluid pressure inlet port 90 disposed centrally of the ends of such sleeve, and fluid pressure is fed simultaneously to such ports 90 by means of an exterior manifold 94 positioned above and in substantially overlying relation to the slide valves 80. The manifold 94 is of cross form and includes feed tubes 96, each of said feed tubes 96 in adjacent parallel relation to a corresponding slide valve 80, though not fully co-extensive therewith, each of the feed tubes 96 connected at their inner ends to a fitting 98 to which a fluid pressure supply conduit 100 is coupled. Adjacent their outer ends, the tubes 96 of manifold 94 are connected in communication with the related inlet ports 90 of the slide valve 80; the tubes 96 being connected to sleeves 82 by welding or other method of forming a fluid tight connection.

At the inner end thereof, the slidable spools 84 of each valve 80 of each set of opposed cylinders 32 are mutually attached at respective opposing ends to a connecting rod 104. Each connecting rod 104 includes a centrally disposed timing control Scotch yoke 106, each such Scotch yoke 106 having a transverse, elongated slot 108; each slot extending at a right angle to the axis of the corresponding connecting rod 104, and the slots of the two rods 104 intersecting in right-angular relation.

As the sets of opposed cylinders 32 are axially offset, relative to each other, the corresponding sets of slide valves 80 are also axially offset, and accordingly there is no interaction between connecting rods 104 or timing control Scotch yokes 40.

The segments of crankshaft 48, 64 are axially aligned, the upper portion 64 of the crankshaft counterbalanced as at 110. Axially offset eccentric portion 62 of crankshaft 48, 64 extends upwardly through slots 108 of slide valve Scotch yokes 106. Rotation of crankshaft 48, 64 causes revolution of the eccentric portion 62 about the axis of crankshaft 48, 64 thereby causing reciprocal movement of connecting rods 104 to effect operation of slide valves 80. The radial position of eccentric portion 62 at any time is a function of the radial position of the selected aperture 68 of timing disk 70, and thus the order of cyclic motion of slide valves 80 can be adjusted by selecting a particular aperture 68. Apertures 68 designated A and B are radially spaced 180 degrees, with apertures C and D spaced 45 degrees from apertures B and A respectively. Moving crankpin 58 from aperture A to aperture B will cause reversal of the direction of rotation of crankshaft 48, 64, whereas selection of aperture C or D effects early or late valving, depending upon the direction of rotation of the crankshaft 48, 64.

Referring now specifically to FIGS. 4(*a*) and 4(*b*), the relation of slide valve 80 to piston 34 action can be seen. Each valve 80 includes an outer port 114 and an inner port 116 in communication between the sleeve 82 and the adjacent cylinder 32; the ports 114 and 116, which are disposed with the inlet port 90 centrally therebetween, are spaced apart a distance having a predetermined relation to the spacing of the spool heads 86. The ports 114 and 116 are positioned short of the related ends of the sleeve 82 whereby upon full reciprocation of the spool 84—by the corresponding slide valve Scotch yoke assembly 106—the spool successively occupies opposite positions in the sleeve 82, and in which positions communication is established first, through port 114, between inlet port 90 and the cylinder 32, and then, through port 116, between such inlet port 90 and said cylinder. At the same successive times, the spool 84 uncovers ports 116 and 114 to permit cylinder exhaust from the ends of the sleeve 82 as indicated by arrows 120 and 122. FIG. 4(*a*) illustrates the relation of spool 84 to piston 34 at the initiation of the downstroke for each cylinder 32. It can be seen that fluid pressure enters inlet port 90 and, due to the position of spool 84, enters port 116 thereby powering the piston 34 through one half cycle of operation, said cycle ending when piston 34 reaches its limit of travel whereupon spool head 86 prevents the application of fluid pressure through port 116 but allows the application of fluid pressure through port 114. Thus, upon reciprocation of each spool 84 of each valve 80, fluid pressure is delivered alternately into the corresponding cylinder 32 on opposite sides of the piston 34 whereby said piston is caused to reciprocate with a double-acting effect. With the configuration as shown, there are 8 power strokes for each revolution of the crankshaft 48, 64.

In operation of the motor 10, upon the introduction of fluid pressure under throttle control into feed conduits 96, pistons 34 reciprocate in substantially the same manner as described in the '391 patent, with the exception that the predetermined cyclic order of piston movement is variable as a result of the selection of a particular one of the apertures 68 in disk 70. Adjustment of slide valve 80 timing, and therefor the order of piston 34 movement may be effected, after cessation of crankshaft 48, 64 rotation, by removing timing lug 66, which may be a cap screw, and rotating timing disc 70 to align a selected aperture 68 with the threaded bore 65 in crankpin 58, said rotation resulting in the repositioning of the spools 84. It can be seen, for example, in FIG. 4(*a*) that if crankpin 58 is positioned at aperture A slide valve 80 for the particular cylinder 32 is positioned to allow fluid pressure into port 116 to power the downstroke, whereas positioning the crankpin 58 at aperture B would position the slide valve 80 as shown in FIG. 4(*b*), effectively advancing the piston 34 by one half cycle. After replacing and tightening the timing lug 66, the motor 10 may be restarted with the timing adjusted as described above.

From the foregoing description, one skilled in the art can easily ascertain the essential characteristics of this invention and, without departing from the spirit and scope thereof, can make various changes and modifications of the invention to adapt it to various usages and conditions.

It is to be understood that the present invention is not limited to the sole embodiment described above, but encompasses any and all embodiments within the scope of the following claims:

I claim:

1. A radial, fluid pressure actuated motor comprising:

sets of opposed axially aligned cylinders arranged in a spaced relation about a crankshaft, each of said sets of cylinders having a common push rod extending therebetween, each of said push rods having a central primary Scotch yoke with an elongated slot, the yokes being arranged in overlying spaced relation, the slots being arranged in right angular intersecting relation;

a main crankpin extending from the crankshaft, said main crankpin extending in journaled but slidable relation through the slots of the central primary Scotch yokes;

said sets of opposed cylinders having a corresponding set of opposed spool valves for controlling application of fluid pressure to the cylinders, said opposed spool valves containing axially reciprocal spools having a common connecting rod extending therebetween, each of said common connecting rods having a centrally disposed timing control Scotch yoke formed therein, and each of said timing control Scotch yokes associated with said common connecting rods having an elongated slot formed therein, the elongated slots being in spaced, overlying, right angular relation;

a timing disc having a central aperture and a plurality of circumferentially spaced timing apertures through which a timing lug may be removably inserted, said timing lug sized for releasable engagement within an aperture formed in said main crankpin; and, valve operating means extending from said timing disc for effecting reciprocal movement of said spools.

2. The motor of claim 1 wherein said main crankpin may be releasably connected to drive said timing disk by placing said timing lug into and through one of said spaced apertures in said timing disk, and threadably engaging said lug in said bore in said main crankpin, whereby timing of said timing control spool valve movement is varied in accordance with selection of a particular one of said spaced timing apertures.

3. The motor of claim 1 wherein said crankshaft includes an upper portion and a lower portion, said upper portion extending from said timing disk and including said valve operating means, said valve operating means comprising an eccentric portion for driving Scotch yokes operably connected to said spool valves, wherein rotation of said upper portion of said main crankshaft causes reciprocal motion of said spool valves.

* * * * *